United States Patent [19]

Aoyama

[11] 4,128,090

[45] Dec. 5, 1978

[54] EXHAUST GAS RECIRCULATION SYSTEM

[75] Inventor: Syunichi Aoyama, Yokohama, Japan

[73] Assignee: Nissan Motor Company, Limited, Japan

[21] Appl. No.: 808,554

[22] Filed: Jun. 21, 1977

[30] Foreign Application Priority Data

Jun. 23, 1976 [JP] Japan ..... 51-74168

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,814,070 | 6/1974 | Wertheimer | 123/119 A |
| 3,834,366 | 9/1974 | Kingsbury | 123/119 A |
| 3,926,161 | 12/1975 | Wertheimer | 123/119 A |
| 3,931,813 | 1/1976 | Horie et al. | 123/119 A |
| 3,982,515 | 9/1976 | Bradshaw | 123/119 A |
| 4,031,871 | 6/1977 | Hamanishi | 123/119 A |
| 4,033,306 | 7/1977 | Kunihiko et al. | 123/119 A |
| 4,041,917 | 8/1977 | Suzuki | 123/119 A |
| 4,056,084 | 11/1977 | Bumgartner | 123/119 A |
| 4,069,797 | 1/1978 | Nohira et al. | 123/119 A |

FOREIGN PATENT DOCUMENTS

| | | | |
|---|---|---|---|
| 2351721 | 5/1974 | Fed. Rep. of Germany | 123/119 A |

*Primary Examiner*—Wendell E. Burns

*Attorney, Agent, or Firm*—Robert E. Burns; Emmanuel J. Lobato; Bruce L. Adams

[57] ABSTRACT

A pressure regulating unit modulates the vacuum present in the vacuum chamber of a vacuum motor operatively connected to an EGR control valve, in response to the pressure differential between the pressure in the EGR passage, between a restriction and the EGR control valve, and the pressure immediately downstream of a restriction in the exhaust conduit, the latter restriction being located downstream of the junction of the EGR passage and the exhaust conduit.

9 Claims, 3 Drawing Figures

30'
30
30a
30a
30b
29
V
27a
35
27c
26a
25
27b
26b
28a
28b
P1
24
20
21
22
P0
P2
37b
37c
37
37a
23
31
38
36

EXHAUST GAS RECIRCULATION SYSTEM

BACKGROUND OF THE INVENTION

This invention relates to a motor vehicle powered by an internal combustion engine which is equipped with an EGR system (a system for recirculating portion of the exhaust gases to the induction manifold of the engine for the purpose of reducing NOx emissions from said engine.) and more particularly to an improved EGR system.

It is well known to recirculate a portion of the exhaust gases emitted from the engine to the induction manifold to produce an air/EGR-gas/fuel mixture which exhibits a reduced rate of combustion in the combustion chamber or chambers of the engine. This reduced rate of combustion reduces the peak combustion temperatures to accordingly maintain the combustion temperature at a level where NOx is virtually not formed. However to achieve effectively the desired reduction of the NOx generation during combustion it is necessary to recirculate rather large amounts of exhaust gas. Combustion chambers have been developed which permit very high rates of EGR to be employed without loss of power output of the engine. However during certain modes of engine operation such as high speed and low load NOx is inherently low and accordingly a reduced rate of EGR can be used without any increase in NOx emissions. However an EGR system for controlling the rate of EGR has not been developed yet which can adequately proportion the amount of exhaust gases introduced into the engine during all modes of engine operation when a very high rate of EGR is employed. Systems which have attempted to achieve the above mentioned degree of control have suffered from various drawbacks such as over sensitivity to variations in exhaust gas pressure in the exhaust manifold and associated exhaust conduit. This so-called over sensitivity has not presented any large problems in EGR systems which recirculate exhaust gases in the order of a few percent. A variation in the amount of EGR gas supplied under the afore mentioned condition produces only a slight change in engine performance. However a small change when using upwards of a 50% EGR rate results in a large change in the amount or volume of exhaust gases in fact introduced into the combustion chamber or chambers. Erratic engine performance immediately results from this rather large change in the volume of EGR gas supplied thereinto. Thus despite the development of combustion chambers having the capacity to combust mixtures containing large quantities of EGR gas the engine as a whole has been unable to produce the desired performance.

There are several possible sources of the afore mentioned pressure variation, these include; accidents which bend or dent the exhaust pipe and or manifold to a degree where an increased back pressure results causing a higher than intended pressure to be present in the EGR passage; carbon deposites in critical places causing a reduction in the effective cross sectional areas of, for example part of the EGR passage; and variations in the dimensions of the exhaust manifold, EGR passage etc. during mass production of same. The latter of course always exists and there is inevitably a car to car variation in the pressure existing in the EGR passage immediately downstream of the valve controlling the flow of the gases through said passage.

Thus there still remains a need for an EGR control system which operates to adequately proportion the amount of exhaust gases recirculated during all modes of engine operation, which is not effected by the above described pressure variations and therefore controls the supply of large amounts of EGR gas to the engine in a manner which ensures optimal output of the engine with greatly reduced NOx emissions.

SUMMARY OF THE INVENTION

In view of the foregoing an EGR system designed to recirculate large quantities of exhaust gas has been developed which uses the rather considerable exhaust gas pressure as a control signal indicative of the amount of induced air rather than the vacuum existing in the venturi portion of the induction system. The latter requiring amplification via complex apparatus before being suitable as the afore mentioned signal. In a detail, the pressure regulating unit of the EGR system is connected to a source of vacuum (the induction manifold at a location remote or distal from the venturi portion) and arranged modulate the degree of vacuum present in the vacuum motor utilized for opening and closing a valve which controls the flow of exhaust gases from the exhaust manifold to the induction manifold, in accordance with two pressure signals from the exhaust system. The first originates in the EGR passage between a restriction and the valve seat of the afore mentioned valve and the second immediately downstream of a restriction in the exhaust conduit downstream of the branching of the EGR passage and the exhaust conduit. Suitable selection of the diameters of the restriction orifices produces a suitable ratio between the two pressures which remains constant despite the previously described variation of the pressure in the exhaust manifold.

Thus it is an object of the present invention to provide an EGR system which is simple in construction, senses the exhaust gas pressure prevailing in two different locations, one in the exhaust manifold, and the other in the EGR passage, and accordingly permits a flow of EGR gas into the induction manifold which is very closely proportioned to the amount of inducted air despite variations of the exhaust gas pressure with respect to the amount of inducted air, with the passing of time and from vehicle to vehicle due to mass production dimension variation.

It is also an object of the present invention to provide an EGR system which reduces the amount of EGR gas normally recirculated under predetermined operating modes of the engine such as high speed low load operation.

BRIEF DESCRIPTION OF THE DRAWINGS

Other features, objects and advantages of the present invention will become more apparent as the description proceeds taken in conjunction with the appended drawings in which.

DESCRIPTION OF THE PREFERRED EMBODIMENTS

Figure 1:
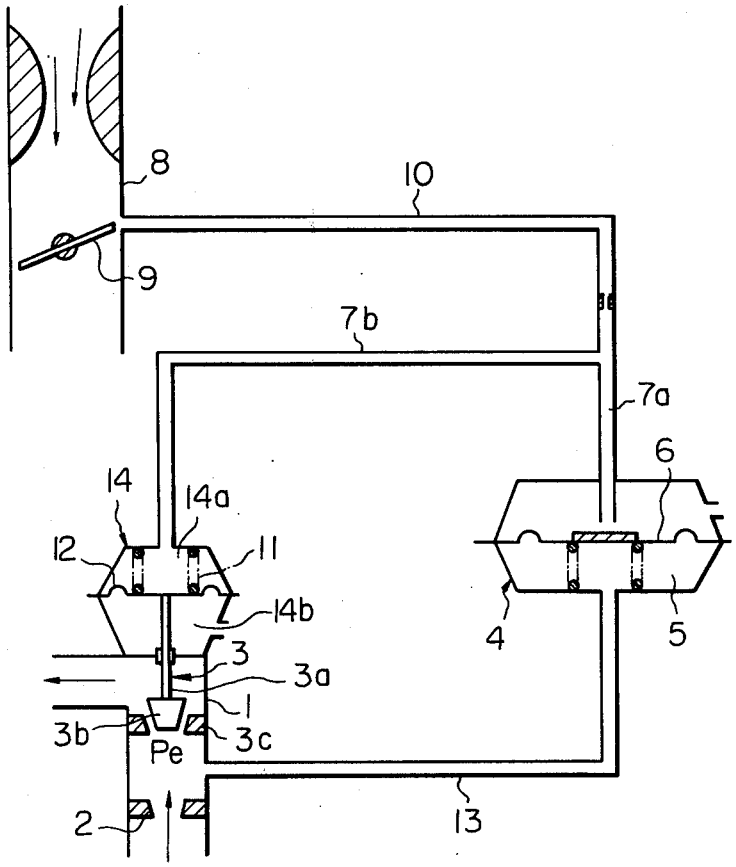
Fig. 1 PRIOR ART
FIG. 1 is a schematic drawing of a prior art EGR system.

Before considering the preferred embodiments of the invention let us turn to FIG. 1 and consider the prior art EGR system shown therein. The numeral 1 denotes an EGR passage in which a restriction 2 is disposed upstream of an EGR control valve 3 (consisting of a valve stem 3a valve head 3b and valve seat 3c). A chamber is defined between the valve seat and the restriction 2 which is as shown fluidly communicated with a chamber of a pressure regulating unit 4 through a conduit 13. Operatively connected to the valve stem 3a is a diaphragm 12 of a vacuum motor 14. Disposed in the vacuum chamber 14a between the casing of the vacuum motor and the diaphragm is a spring 11 which is arranged to bias the diaphragm 12 into the atmospheric chamber 14b and thus urge the valve head 3b into sealing engagement with the valve seat 3c. A conduit 7b fluidly connected at one end to the vacuum chamber 14a of the vacuum motor 14 is arranged to fluidly communicate with two other conduits 10 and 7a. The first conduit 10 which has a restriction (no numeral) disposed therein is arranged as shown to communicate with a portion of the induction manifold at a location which is immediately upstream of the throttle valve 9, rotatably disposed in the induction manifold downstream of the venturi portion, when it is in a fully closed position. Hence when the throttle valve is fully closed a positive pressure or atmospheric pressure is fed therein and when it is open a negative pressure or vacuum is fed therein. The second conduit 7a interconnects conduits 10 and 7b with the atmospheric chamber of the pressure regulating unit 4, and is arranged to project into afore mentioned chamber so as to juxtapose a member formed on the diaphragm 6 disposed in the pressure regulating unit. The diaphragm 6 divides the casing of the pressure regulating unit 4 sealingly into the afore mentioned atmospheric chamber and the pressure chamber 5 which is exposed to the pressure prevailing in the chamber defined between the restriction 2 and the valve seat 3c.

In operation when the throttle valve is closed a positive pressure is fed to the vacuum chamber 14a of the vacuum motor 14 via conduits 10 and 7b. This urges the valve head 3b firmly against the valve set 3c to cut the flow of exhaust gases into the induction manifold (connection no shown). Thus the pressure in the chamber defined between the valve seat and the restriction 2 rises to urge the diaphragm 6 to position where the member formed thereon closed the end of the conduit 7a to ensure a positive pressure prevails in the vacuum chamber 14a.

When the throttle valve is opened the positive pressure disappears and is replaced by a negative pressure pressure so that the valve 3 is opened to permit the flow of EGR gas via the resulting flexing of the diaphragm 12 into the vacuum chamber 14a. The pressure Pe in the afore-mentioned chamber (between the restrictor and the valve seat) drops accordingly, and the upon reaching a given value the diaphragm 6 is permitted to move away from the position in which it closes the conduit 7a thus permitting the vacuum being fed from the induction manifold to be modulated by the introduction of atmospheric air into the conduits 7a and 7b. Thus variations in the pressure Pe and the degree of vacuum prevailing in the induction manifold at the point or location where the conduit 10 joins same, control the amount of EGR gas introduced into the induction manifold. Accordingly it is necessary to design the apparatus around parameters such as the exhaust pressure developed for a given amount of inducted air and the degree of vacuum present in the induction manifold at this time.

Now with the passing of time should the pressure prevailing in the exhaust manifold for a given volume of inducted air change for any of the reasons set forth under the heading of "description of the prior art" the volume of exhaust gases in fact recirculated will change accordingly. Hence the afore-described problem will be encountered if the EGR rate is not within a few percent.

Figure 2:
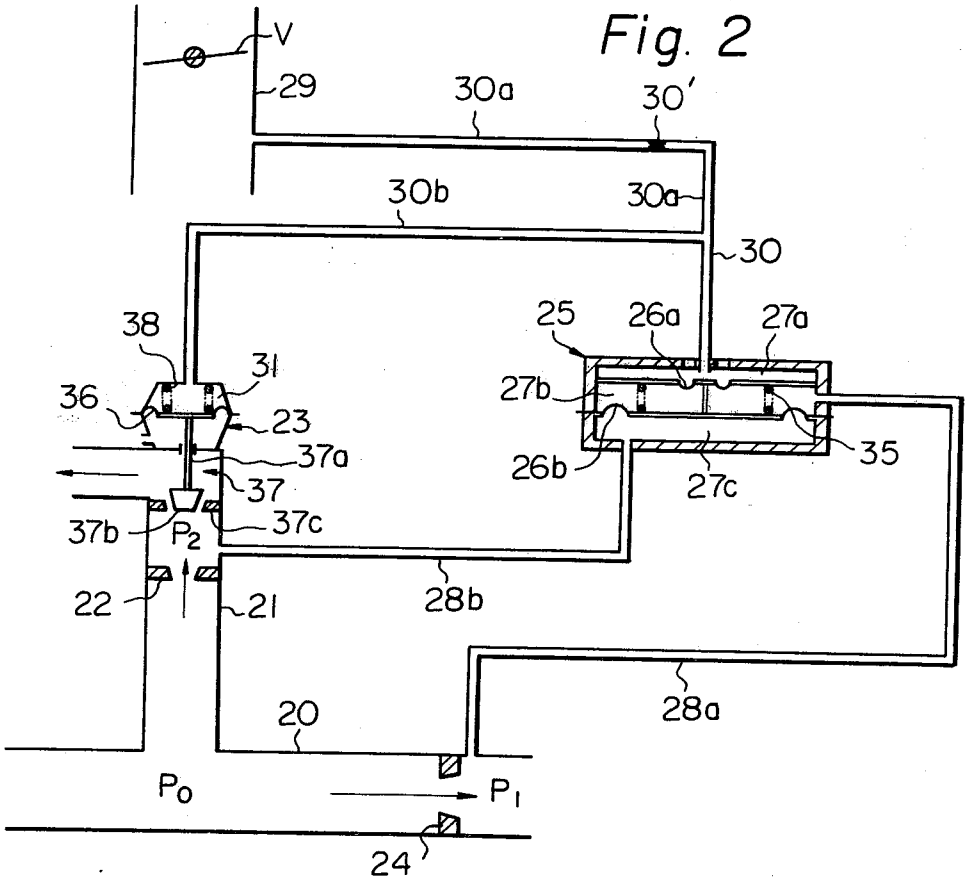
FIG. 2 is a schematic drawing of an EGR system according to the first preferred embodiment of the present invention.

Referring now to FIG. 2 of the drawings, a first preferred embodiment of an EGR (Exhaust Gas Recirculation) system according to the present invention is shown and in which the numeral 20 indicates an exhaust conduit operatively connected to an internal combustion engine (not shown) for receiving exhaust gases thereinto. Fluidly communicating with the exhaust conduit 20 at a first end thereof is an EGR passage 21. Although not shown, the other or second end of the EGR passage 21 fluidly communicates with the induction manifold or intake passage 29 of the engine to introduce exhaust gases, transferred through the EGR passage 21, thereinto. As usual, the intake passage 29 is connectable to the combustion chamber or combustion chambers (not shown) of the engine to feed the combustion chamber with air-fuel mixture prepared by known air-fuel mixture preparing device (no numeral) such as a carburetor. The air-fuel mixture preparing device may be one including a fuel injection system. A part of the intake passage 29 is formed in the air-fuel mixture preparing device of which throttle valve V is rotatably disposed in the above-mentioned part of the passage 29. Operatively mounted in the passage 21 is an EGR control valve generally denoted by the numeral 37. As shown the valve consists of a valve stem 37a, a valve head 37b and a valve seat 37c. Formed or disposed in the EGR passage 21 upstream of the valve seat 37c is a restriction or orifice 22. Another restriction or orifice 24 is disposed in the exhaust conduit 20 at a location downstream of the intersection, or branching of the EGR passage 21 and the exhaust conduit 20. A vacuum motor denoted by the numeral 23 is mounted on the EGR passage 21 in such a manner that a diaphragm 36 thereof is connected to the valve stem 37a so that flexing thereof directly induces reciprocating motion of the valve stem and head to open and close the valve 37. The vacuum chamber 31 has a spring 38 disposed therein to bias the diaphragm into the atmospheric chamber (no numeral) of the vacuum motor 23 (i.e. away from the vacuum chamber).

A pressure regulating unit 25 consists of a casing (no numeral) sealingly divided into three chambers 27a, 27b and 27c by two diaphragms 26a and 26b.

The first chamber 27a is communicated with the atmosphere through an opening (no numeral) formed in the casing. A conduit 30 is arranged as shown to pass through the casing so that the end thereof juxtaposes the first diaphragm 26a in such a manner that upward flexing of the diaphragm 26a toward the portion of the casing through which the conduit 30 is disposed reduces the communication between the holes providing communicating with the atmosphere and the inlet orifice of the afore-mention conduit 30 and finally cuts same. The conduit 30 is branched to fluidly communicate with two other conduits 30a and 30b. The conduit 30a communicates with the induction manifold or passage 29 at a location downstream of the throttle valve so as to tap into a variable source of vacuum. A restriction 30' is disposed in the conduit 30a between the induction manifold and the branched conduit 30b. The conduit 30b is arranged to fluidly communicate with the vacuum chamber 31 of the vacuum motor 23 to supply the vacuum tapped from the induction manifold thereinto. The vacuum in fact reaching the vacuum chamber 31 is modified by the degree of opening between the end of the conduit 30 which opens into the first chamber 27a and the first diaphragm 26a.

The second chamber 27b is communicated with the exhaust conduit 20 at a location downstream of the restriction 24 through a conduit 28a. Thus the chamber 27b is exposed to the pressure which exists downstream of the restriction 24 which is denoted by $P_1$ in FIG. 2.

The third chamber 27c is communicated with the chamber defined between the valve seat 37c and the restriction 22 so as to be exposed to the pressure prevailing therein. This pressure is denoted by $P_2$. Now it should be pointed out that the afore mentioned pressures $P_1$ and $P_2$ normally have absolute values lower than atmospheric i.e. are normally vacuums. This situation is brought about by the increase of velocity of the exhaust gases as they pass through the orifices formed in the restrictions. As shown the first diapjragm 26a is smaller in effective surface area than the second diaphragm 26b. A spring 35 is disposed between the partition (no numeral) to which the first diaphragm 26a is fixedly attached and the second diaphragm 26b to bias the latter in the direction of the third chamber 27c.

The two diaphragms 26a and 26b are as clearly shown interconnected by a rod (no numeral) attached at its ends to the diaphragms at substantially their midpoints to ensure their simultaneous movement.

At this time, it is considered advantageous to consider the fundamentals of the operation of the present invention before describing the actual operational steps.

It will be appreciated that it is extremely important to select the diameters of the orifices in the restrictions 22 and 24 according to the present invention because these determine the flow rates through the EGR passage 21 and the exhaust conduit 20. As can be seen in FIG. 2 the square of the rate of flow of the exhaust gases through the exhaust conduit 20 is proportional to $(P_o - P_1)$ or the pressure differential on either side of the restriction 24 and the flow rate of the exhaust gases through the EGR passage 21 is proportional to $(P_o - P_2)$ or the pressure differential on either side of the restriction 22. It will also be appreciated that the flow rate of exhaust gases actually being exhausted from the engine through the exhaust conduit 20, i.e. $\sqrt{(P_o - P_1)}$, is proportional to the rate of air inducted into the induction manifold 29 viz. the volume of gases inducted deformines the amount of gases in fact exhausted.

Now if the amount of exhaust gases recirculated is controlled, as is highly desirable with respect to the volume of inducted air (in this case proportional to the exhaust gas flow rate or $\sqrt{(P_o - P_1)}$, a desirable volume of exhaust gases will be introduced into the engine. Since the pressure regulating unit 25 is sensitive to pressures $P_1$ and $P_2$ which are in fact representative of the flow rates represented by $(P_o - P_1)$ and $(P_o - P_2)$ controlling the pressure regulating unit with respect to a preselected ratio of $P_1$ and $P_2$, the flow rates through the EGR passage 21 and the exhaust conduit 20 will be similarly proportional. This of course is quite different from the prior art where recirculation is controlled with respect to the absolute value of the exhaust gas pressure only.

Thus it will be obvious that, by selecting the diameters of the orifices in the restrictions 22 and 24 and selecting a suitable ratio of the effect of each of the pressures $P_1$ and $P_2$ (i.e. selecting appropriate diameters and effective working areas of the diaphragms in the pressure regulating unit 25), an adequate proportioning of the exhaust gases will be assured despite pressure variations of the nature set forth earlier in this disclosure.

In operation when the engine is in an idling mode of operation and the pressure in the exhaust conduit 20 is relatively low and the vacuum in the induction manifold 29 is relatively high, the diaphragms 26a and 26b will be flexed in the direction of the chamber 27c by the action of the spring 35 to open the conduit 30. The action of the spring 35 directly influences the first diaphragm 26a due to the connection via the rod interconnecting same with the second diaphragm 26b. Hence, as the spring urges the second diaphragm 26b toward the third chamber 27c, the rod draws the first diaphragm 26a in the same direction. This permits substantially atmospheric pressure to prevail in the vacuum chamber 31, since the magnitude of the vacuum in the induction manifold is all but bled off by the atmospheric air passing through the conduit 30. Thus, at this time, the EGR control valve 37 is closed under the influence of the spring housed in the vacuum chamber 31. Now as long as the absolute values of the pressures $P_1$ and $P_2$ remain above given levels, the above described condition will continue. However as the throttle valve opens and the volume of inducted air rises, the pressure of the exhaust gases will also rise. Hence as pressure $P_1$ and $P_2$ fall, the diaphragms in the pressure regulating unit 25 will be urged against the biasing force of the spring 35. Simultaneously the degree of vacuum prevailing in the induction manifold 29 rises and is fed via conduits 30a and 30b to the vacuum chamber 31. The amount of vacuum bled off is reduced as the pressures $P_1$ and $P_2$ fall. The thus modulated vacuum in the vacuum chamber opens the EGR control valve to permit the flow of exhaust gases.

During steady state operation of the engine, should the engine begin to receive too much EGR gas, the pressure $P_2$ in the chamber defined between the EGR control valve 37 and the restriction 22 will fall with respect to the pressure $P_1$ in the exhaust conduit. Hence at this time, the diaphragms 26a and 26b will flex due to the change in the pressure differential $(P_1 - P_2)$ to increase the amount of air permitted into the conduit 30 from the atmospheric chamber 27a. The degree of vacuum in the vacuum chamber 31 will drop permitting the valve head 37b to approach the valve seat 37c to reduce the volume of exhaust gases passing therethrough. The pressure $P_2$ will immediately begin to rise until the predetermined ratio of $P_1$ to $P_2$ (or pressure differential $P_1 - P_2$) in the pressure regulating unit is satisfied whereupon the diaphragms will again flex to reduce the amount of air entering the conduit 30. Thus via the above described feedback operation any deviation in pressure in the EGR passage with respect to that in the exhaust conduit 20 (and vice versa) will be quickly rectified.

Figure 3:
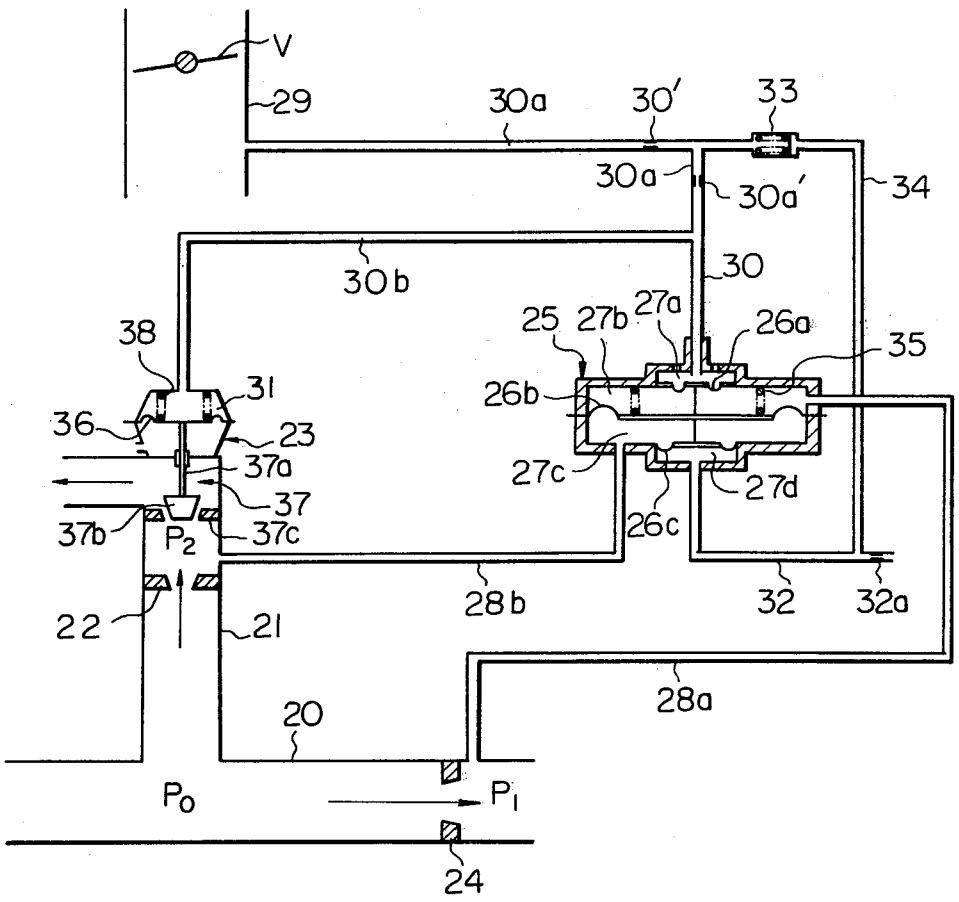
FIG. 3 is a schematic drawing of an EGR system according to a second preferred embodiment of the present invention.

Let us now turn to FIG. 3 wherein second preferred embodiment similar in basic operation to the first preferred embodiment is shown. However the second preferred embodiment is equipped with an additional circuit for modifying the operation of the pressure regulating unit during high speed and low load operation of the engine. As previously described it is unnecessary to recirculate large quantities of EGR gas due the inherent low production of NOx during this mode.

Since the system of the second preferred embodiment is basically the same except for a few additional components, a detailed description of the entire system will be omitted for previty. Now as seen in the figure a third diaphragm 26c is provided within the casing to define, in this case, four chambers 27a, 27b, 27c and 27d. Only the last is new, the others being functionally the same as in the first preferred embodiment. The diaphragm 27d is fixedly connected to the other diaphragms through a rod (no numeral) for simultaneous movement therewith. The chamber 27d is communicated with the atmosphere through a conduit 32 which has a restriction 32a disposed therein to limit said communication. Fluidly connected to the conduit 32 at a location between the restriction 32a and the chamber 27d is a conduit 34. The conduit 34 fluidly communicates with the aforedescribed conduit 30a at a location between the branching of the conduits 30, 30a and 30b and the restriction 30'. Operatively disposed in the conduit 34 is a check or relief valve 33. Another restriction 30a' is disposed in the conduit 30a between the junction of the conduit 34 with said conduit 30a and the junction or branching of the conduits 30, 30a and 30b.

The operation of the system shown in FIG. 3 is identical with that shown in the FIG. 2 up until a predetermined engine speed when the vacuum prevailing in the induction manifold 29 exceeds a predetermined value to overcome the force closing the check valve 33. Prior to the opening of the check valve 33 atmospheric pressure prevails in the fourth chamber 27d. The selection of the diameters of the orifices in the restrictions may be arranged to compensate for the effect of the fourth chamber.

Now when the check valve 33 opens, the vacuum prevailing in the induction manifold 29 is fed through the conduits 30a and 34 (and simultaneously through conduits 30b and 30) is partially bled off by the atmospheric air entering the conduit 32 through the restriction 32a and finally fed into the fourth chamber 27d via conduit 32. The pressure having changed from atmospheric to less than same induces the flexing of the third diaphragm 37d into the fourth chamber 27d. This, by way of the rods interconnecting the other diaphragms, causes the first diaphragm to flex so as to increase the amount of air permitted to enter the vacuum chamber 31 via conduits 30 and 30b. The reduction of the vacuum prevailing in the chamber 31 permits a reduction of the opening of the EGR valve 37 via the action of the spring disposed in said vacuum chamber. Thus, as long as the engine runs at the aforementioned high speed and low load, an equilibrium between the pressure $P_1$, $P_2$ and the pressure in the fourth chamber 27d will reduce the amount of EGR gases introduced in the engine.

The afore-described reduction in the volume of the EGR gases is highly advantageous because it permits the engine to run stably at high speeds using less fuel (than normally required if the high rate of EGR is continued) and simultaneously produce very little NOx (because some EGR is maintained to suppress the little formation which would noramlly take place in the case of no EGR).

What is claimed is:

1. An EGR system for an internal combustion engine having an induction manifold and an exhaust conduit comprising:

means defining an EGR passage fluidly interconnecting the induction manifold and the exhaust conduit for recirculating a portion of the exhaust gases emitted from the engine into the exhaust conduit into the induction manifold for introduction into the combustion chamber;

EGR control valve means operatively disposed in the EGR passage for controlling the amount of exhaust gas passing therethrough in response to a vacuum signal fed to said EGR control valve means from the induction manifold;

pressure regulating means fluidly communicating with the atmosphere, the EGR passage and the exhaust conduit for receiving respectively therefrom atmospheric air, first pressure signal and a second pressure signal and also communicating said EGR control valve means in such a manner as to modulate, via the introduction of atmospheric air, the vacuum signal fed from the induction manifold to the EGR control valve means, in response to the pressure differential between said first and second pressure signals; and first and second restriction means disposed in the EGR passage and the exhaust conduit respectively, the pressure prevailing in the chamber defined between said first restriction means and the EGR control valve neans functioning as the source of said first pressure signal and the pressure prevailing in the region immediately downstream of the said second restriction means functioning as the source of said second pressure signal.

2. An EGR system as claimed in claim 1 wherein said first and second restriction means comprise first and second restrictions the orifices of which are so selected that the pressure differential produced upstream and downstream thereof induce flow rates therethrough so that the pressure immediately downstream of each have predetermined ratio with respect to one and other.

3. An EGR system as claimed in claim 1 wherein said EGR control valve means comprises:

a valve consisting of a valve stem, a valve head fixedly mounted on a first end thereof and a valve seat, said valve seat being mounted in the EGR passage and arranged so that the valve head is seatable thereon; and a vacuum motor consisting of a vacuum chamber and an atmospheric chamber sealingly divided by a flexible diaphragm, the second end of the valve stem being connected to said diaphragm for simultaneous therewith and a spring disposed in the vacuum chamber to bias the diaphragm in a direction which moves the valve head toward the valve seat.

4. An EGR system as claimed in claim 1 wherein said pressure regulating means comprising:

a casing having therein first and second interconnected diaphragms which sealingly divide the casing into first, second and third chambers said first chamber fluidly communicating with the atmosphere via a through hole formed in the casing, and the induction manifold and said vacuum chamber of said vacuum motor via a first conduit means, said second chamber fluidly communicating with the exhaust conduit immediately downstream of said second restriction means via a second conduit means, and said third chamber fluidly communicating with said chamber defined between said first restriction means and said valve seat via a third conduit means the arrangement of the above being such that said first pressure signal is introduced into said third chamber via said third conduit means, said second pressure signal is introduced into said second chamber via said second conduit means so that the pressure differential between said first and second pressure signals biases said interconnected first and second diaphragms so as to modulate the vacuum prevailing in said vacuum chamber by varying the amount of atmospheric air permitted to pass from said through hole into said first conduit means.

5. An EGR system as claimed in claim 1 wherein said pressure regulating means comprises, a casing having therein first, second and third interconnected diaphragm which sealingly divide the casing into first, second third and fourth chambers, said first chamber fluidly communicating with the atmosphere via a through hole formed in the casing, and the induction manifold and said vacuum chamber of said vacuum motor via a first conduit means, said second chamber fluidly communicating with the exhaust conduit immediately downstream of said second restriction means via a second conduit means said third chamber fluidly communicating with said chamber defined between said first restriction means and said valve seat via a third conduit means, and said fourth chamber fluidly communicable with the atmosphere and the induction manifold via fourth conduit means, the arrangement of the above being such that said first pressure signal is introduced into said third chamber via said third conduit means and said second pressure signal is introduced into said second chamber via said second conduit means so that the pressure differential between said first and second pressure signals biases said interconnected first, second and third diaphragms so as to modulate the vacuum prevailing in the said vacuum chamber by varying the amount of atmospheric air permitted to pass from said through hole into said first conduit means; and above a predetermined engine speed, indicative of high speed and low load operation of said engine, vacuum from said induction manifold, permitted to enter said fourth conduit means, be modulated by the introduction of atmospheric air thereinto and introduced into the otherwise normally atmospheric fourth chamber to further bias said interconnected first second and third diaphragms so as to permit an increased amount of air to enter the first conduit means.

6. An EGR system as claimed in claim 5 wherein said first conduit means comprises, a first conduit arranged to communicate with the induction manifold at a location downstream of the throttle valve operatively disposed therein and project into said first chamber so as to juxtapose the first diaphragm, a second conduit interconnecting the first conduit with said vacuum chamber and a first restriction disposed in the first conduit between the junction of the first and second conduits and the induction manifold.

7. An EGR system as claimed in claim 6 wherein said fourth conduit means comprises:

a third conduit connected at one end to said fourth chamber and with the atmosphere at the other end;

a second restriction disposed in said third conduit between said second restriction and said fourth chamber and at the other to said first conduit of said first conduit means at a location between the junction of said first and second conduits and said first restriction;

a check valve disposed in said fourth conduit between the junction of said first and fourth conduits and the junction of said third and fourth conduits; and a third restriction disposed in said first conduit between the junction of said first and fourth conduits and the junction of said first and second conduits.

8. An EGR system as claimed in claim 4 further comprising biasing means disposed between said first diaphragm and said second diaphragm so that one end thereof abut the casing and the other abuts the second diaphragm to bias the interconnected first and second diaphragms in a direction which moves the first diaphragm away from the end of said first conduit.

9. An EGR system as claimed in claim 5, further comprising biasing means disposed between said first diaphragm and said second diaphragm so that one end thereof abuts the casing and the other abuts the second diaphragm to bias the interconnected first, second and third diaphragms in a direction which moves the first diaphragm away from the end of said first conduit.

* * * * *